United States Patent [19]

Johansson

[11] 4,377,204

[45] Mar. 22, 1983

[54] PLATE HEAT EXCHANGER

[75] Inventor: Karl B. V. Johansson, Helsingborg, Sweden

[73] Assignee: Alfa-Laval AB, Tumba, Sweden

[21] Appl. No.: 258,930

[22] Filed: Apr. 30, 1981

[51] Int. Cl.[3] ..... F28F 3/00
[52] U.S. Cl. ..... 165/166
[58] Field of Search ..... 165/166, 167

[56] References Cited

FOREIGN PATENT DOCUMENTS

| | | | |
|---|---|---|---|
| 109802 | 2/1940 | Australia | 165/166 |
| 67709 | 9/1946 | Denmark | 165/166 |
| 2028966 | 3/1980 | United Kingdom | 165/167 |

*Primary Examiner*—Albert W. Davis, Jr.
*Assistant Examiner*—John F. McNally
*Attorney, Agent, or Firm*—Cyrus S. Hapgood

[57] ABSTRACT

Each plate of the heat exchanger has the usual groove for receiving a gasket; but the latter is secured to the plate at fastening points spaced from each other and located outside the sealing area defined by the groove.

8 Claims, 13 Drawing Figures

PLATE HEAT EXCHANGER

The present invention relates to a plate heat exchanger in which each heat exchanging plate has one or more pressed grooves for gaskets arranged to seal between the heat exchange plate and an adjacent heat exchange plate and thereby delimit the heat exchange area and the through-flow holes outside such area.

Plate heat exchangers are assembled by hanging the plates with their gaskets vertically on a supporting rod arranged horizontally. The plates are then clamped together in a frame-work. In order to facilitate the assembly and removal of the heat exchange plates, the gaskets are glued in the gasket grooves before starting the assembly, according to the present art. The function of the glue line is consequently to hold the gasket on the plate during the handling.

This method, however, has a number of disadvantages. The gluing is a complicated process with a number of steps which must be carried through with great precision, and it is consequently very expensive. The areas must be clean and degreased before the glue can be applied. It may be difficult to get the long, thin gasket to remain in the groove in the plate, especially when applied to large plates. In order to have the gasket and the plate abut against each other when the glue has been applied, the plate is clamped against a curing platform, after which the glue line is cured in an oven. Not until the package with the curing platform and the plate is cooled may the package be opened. The surplus glue is then removed and a visual control of the glue line is effected.

The gluing operation also requires special consideration to the surroundings, as by providing good ventilation of the room where the gluing takes place.

If it should be necessary to replace a gasket, as due to a leakage, when the plate heat exchanger has been in use for a certain time, it may be difficult to remove the used gasket and the remaining glue from the packing groove. It may be so difficult and time consuming to replace the gaskets in the field that the whole apparatus must be returned to the manufacturer for repair.

The present invention solves the problems created by fastening the gaskets on the heat exchange plates of a plate heat exchanger. According to the invention, the gasket has fastening points spaced from each other and located outside the sealing area defined by the gasket groove, at which fastening points the gasket is fixed to the heat exchange plate. With this arrangement, the fastening of the gasket does not take place in the sealing area of the gasket groove but outside the same.

According to a preferred embodiment of the invention, the elongated gasket is provided with projecting tabs on the remote side from the heat exchange area, which tabs are fastened to the plate. A variant of this is that the points of the gasket which are fastened to the plate are joined, as by means of a thin strip of gasket material.

The projecting tabs may be fastened to the plate either by means of a mechanical fixing or through gluing. The problem noted above regarding the gluing operation are diminished in that the gluing operation is made easier and a smaller amount of glue is used, which means that the problem concerning the surroundings diminish. It is also easier to remove the gasket from the plate, since a smaller glue line must be removed.

According to the invention, it is also possible to fasten the gasket mechanically to the plate, whereby the problems of gluing are avoided entirely.

The mechanical fastening mentioned above may be achieved in a number of ways within the scope of the invention. According to a preferred embodiment, each tab is provided with a pin which is inserted in a hole in the heat exchange plate. According to another embodiment, the tab is given a T-form and the heat exchange plate is provided with notches in the plate outside the gasket groove. The transverse tabs in the T are inserted through these notches. In order to increase the sealing ability on the underside of the gasket, it may be provided with one or more longitudinal projections or rims on its underside.

Another way of obtaining a fastening is to fasten the projecting tabs against the plate by removable fastening means, such as clips.

The plate heat exchanger according to the invention is described below with reference to the attached drawings, which show examples of gaskets intended for mechanical fastening to the plates. In the drawings.

Figure 1:
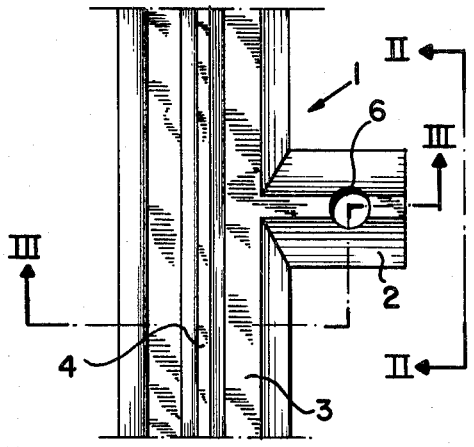
FIG. 1 is a plan view of part of a gasket provided with a projecting tab and a pin.
Figure 2:
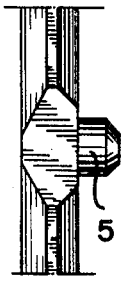
FIG. 2 is a side elevational view of the gasket tab in FIG. 1.
Figure 3:
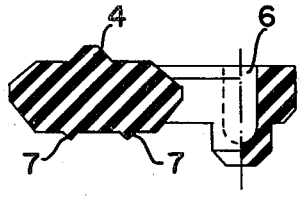
FIG. 3 is a sectional view along line III—III in FIG. 1.

As may be seen in FIG. 1, a gasket 1 is provided with projecting tabs 2. The elongated part 3 of the gasket is intended to be placed in a groove extending around a heat exchange plate. The gasket has a rim 4 on its upper side intended to abut against an adjacent heat exchange plate. The projecting tab 2 is provided with a pin 5 (FIG. 2) on its under side. There is also a hole or recess 6 with the upper part of the pin. The gasket 1 also has two longitudinal projections or rins 7 on its underside, which may be seen in FIG. 3.

Figure 5:
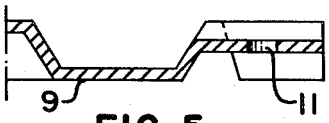
FIG. 5 is a sectional view along line V—V in FIG. 4.
Figure 4:
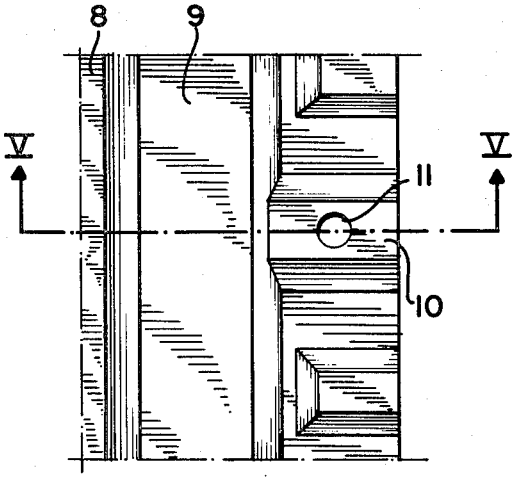
FIG. 4 is a plan view of part of a heat exchange plate to be used with the gasket according to FIG. 1.

A part of a plate 8 provided with gasket grooves 9 extending along the periphery of the plate is shown in FIGS. 4 and 5. The part of the plate 8 located outside the gasket groove is provided with depressed patterns. Part of these patterns have been pressed only to the half pressing depth. In such a pressed crease 10 there is a notch or hole 11 for receiving the pin 5 on the projecting tab 2.

When assembling the gasket on the plate, the elongated part 3 of the gasket is placed in the gasket groove 9 in such a way that the pin 5 is located over the hole 11. By downward pressing of a needle or a finger in the hole 6, the pin is elongated and thus made so much thinner that it can be pressed through the hole 11 in the plate. When the downward force is released, the pin strives to take back its original shape, but since the hole in the plate is smaller than the diameter of the pin, an extension of the pin on the under side of the plate is obtained which efficiently holds the gasket in place.

Figure 6:
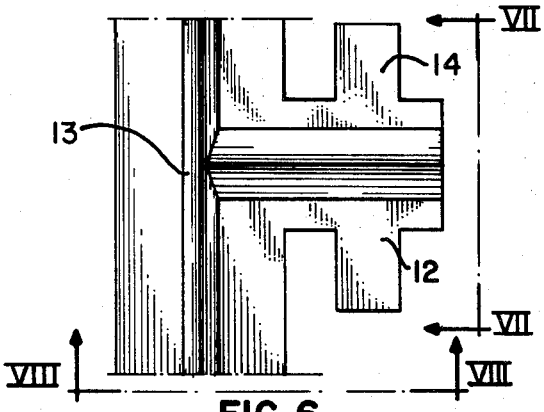
FIG. 6 is a plan view of part of another gasket provided with projecting tabs of T-shape.
Figure 7:
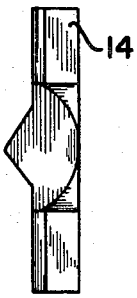
FIG. 7 is a side elevational view of the gasket tab in FIG. 6.
Figure 8:
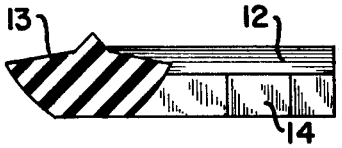
FIG. 8 is a section view along a line VIII—VIII in FIG. 6.
Figure 10:
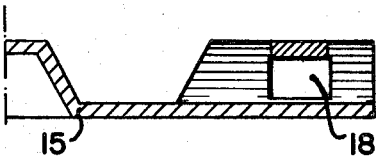
FIG. 10 is a sectional view along line X—X in FIG. 9.
Figure 9:
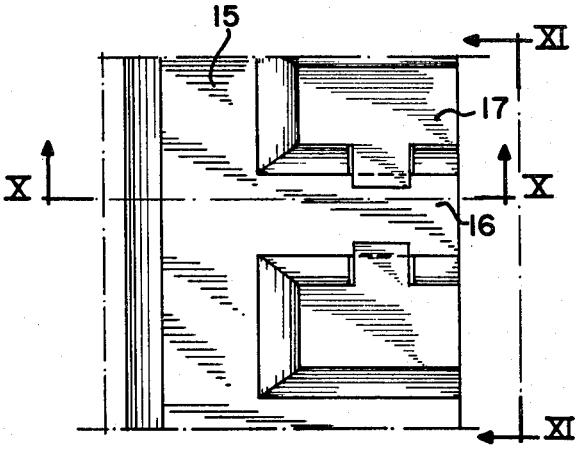
FIG. 9 is a plan view of part of a heat exchange plate to be used with the gasket according to FIG. 6.
Figure 11:
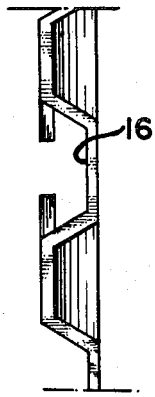
FIG. 11 is a side elevational view of the plate of FIG. 9.

In the arrangement shown in FIGS. 6–11, the gasket is provided with a projecting tab 12 of mainly T-shape. Also, the elongated part of the gasket has a rim 13 on its upper side increasing the sealing ability. In FIGS. 6 and 7 there are shown the projecting parts 14 of the T-shaped tab. In FIG. 9, the heat exchange plate is provided with a groove 15 for the elongated gasket. From the groove 15 there extends a groove 16 for the projecting T-shaped tab 12. On the edges of the groove 16, parts 17 of the plate have been cut and folded so that openings or notches 18 are obtained under the parts 17. Through these openings 18, the projecting parts 14 of the tab are pushed so as to secure the gasket to the plate.

Figure 12:
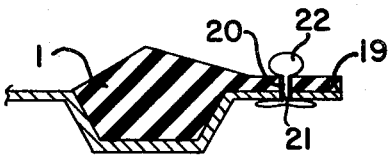
FIGS. 12 and 13 are cross-sectional views of two further arrangements for fastening the gasket mechanically to the plate.

In FIG. 12 there is shown a gasket 1 with a projecting tab 19. In the tab 19 is stamped hole 20. The gasket is arranged so that the hole 20 is located over a hole 21 through the plate. Through these holes 20 and 21 a fastening means, such as a metallic or plastic clip 22, is inserted and fastened on the underside of the plate.

Figure 13:
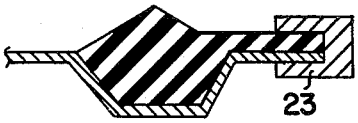

In FIG. 13 there is shown another method of mechanically fastening the projecting tab 19 to the plate, namely, by means of a clamp 23 which grips on both the gasket tab and the plate.

The arrangement shown in FIGS. 1–5 for fastening the gasket has the advantage that by studying the backside of the plate, it can be determined when no openings 11 in the plate lack projecting parts of the gasket, which means that the gasket is fixed to the plate at all possible fastening points.

If it is desired to fasten the gasket tab by means of gluing instead of the parts 14 in FIGS. 6–10, the projecting parts 14 may be omitted and replaced by a glue lime between the gasket and the plate at a suitable place in the groove 16.

According to the present invention, the gasket may be provided with projecting tabs along the whole of its length, which tabs are fastened to the plate. If packing arrangements including separate gasket rings are used for the through-flow holes in the plates, these rings are also provided with projecting tabs along their peripheries.

Within the scope of the invention, many different arrangements are possible; but all of them have in common that the fastening of the gasket takes place outside the sealing area.

I claim:

1. In combination with a heat exchange plate having a pressed groove defining a sealing area, a gasket having a part adapted to seal in said groove, the gasket being adapted to seal against an adjacent heat exchange plate to define a heat exchange area of each plate, the gasket having fastening points spaced from each other and located outside the sealing area defined by said groove, and means for securing the gasket to the plate at said fastening points.

2. The combination of claim 1, in which said securing means include tabs projecting from the side of the gasket remote from said heat exchange area.

3. The combination of claim 2, in which the heat exchange plate has notches spaced outwardly from said groove, said tabs being engageable in the notches to secure the gasket to the plate.

4. The combination of claim 2, in which the tabs are glued to the plate.

5. The combination of claim 2, in which the heat exchange plate has holes spaced outwardly from said grooves, said securing means also including a pin projecting from each tab and receivable in a said hole.

6. The combination of claim 2, in which the heat exchange plate has notches spaced outwardly from said groove, each said tab being generally T-shaped to form elements receivable in said notches.

7. The combination of claim 2, in which said securing means also include clamps for fastening the tabs to the plate.

8. The combination of claim 1, in which the gasket also has longitudinal projections on its underside for increasing its sealing ability.

* * * * *